US010337142B2

(12) United States Patent
Ohashi et al.

(10) Patent No.: US 10,337,142 B2
(45) Date of Patent: Jul. 2, 2019

(54) TEXTILE PRINTING METHOD

(71) Applicant: Seiko Epson Corporation, Tokyo (JP)

(72) Inventors: Masakazu Ohashi, Shiojiri (JP); Toru Saito, Yamagata (JP); Masayuki Murai, Matsumoto (JP); Ryota Miyasa, Matsumoto (JP); Takako Sugiyama, Azumino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/659,976

(22) Filed: Jul. 26, 2017

(65) Prior Publication Data

US 2018/0058002 A1 Mar. 1, 2018

(30) Foreign Application Priority Data

Aug. 23, 2016 (JP) ..... 2016-162807

(51) Int. Cl.

| | |
|---|---|
| ***B41J 2/01*** | (2006.01) |
| ***D06P 1/44*** | (2006.01) |
| ***D06P 1/52*** | (2006.01) |
| ***D06P 3/52*** | (2006.01) |
| ***D06P 5/30*** | (2006.01) |
| ***B41J 3/407*** | (2006.01) |
| ***D06P 5/20*** | (2006.01) |

(52) U.S. Cl.

CPC . *D06P 5/30* (2013.01); *B41J 2/01* (2013.01); *B41J 3/4078* (2013.01); *D06P 1/445* (2013.01); *D06P 1/52* (2013.01); *D06P 3/52* (2013.01); *D06P 5/2072* (2013.01)

(58) Field of Classification Search

CPC ..... D06P 5/30; D06P 1/44; D06P 3/52; B41J 3/4078

See application file for complete search history.

(56) References Cited

U.S. PATENT DOCUMENTS

| | | | | |
|---|---|---|---|---|
| 5,510,415 | A * | 4/1996 | Zahrobsky | D06P 1/44 347/100 |
| 5,847,729 | A * | 12/1998 | Takahashi | B41J 2/2103 347/43 |
| 6,024,431 | A * | 2/2000 | Takahashi | B41J 2/04571 347/106 |
| 6,264,731 | B1 * | 7/2001 | Gundlach | C09D 11/30 106/31.43 |
| 2010/0214352 | A1 | 8/2010 | Tsunoda et al. | |
| 2012/0306976 | A1 * | 12/2012 | Kitagawa | C09D 11/326 347/100 |

(Continued)

FOREIGN PATENT DOCUMENTS

JP 2014-163021 A 9/2014

OTHER PUBLICATIONS

Extended European Search Report for Application No. EP 17 18 6576 dated Nov. 17, 2017 (10 pages).

*Primary Examiner* — John Zimmermann

(74) *Attorney, Agent, or Firm* — Harness, Dickey & Pierce, P.L.C.

(57) ABSTRACT

A textile printing method includes heating a cloth, and applying an ink composition onto the heated cloth by ejecting the ink composition from an ink jet head. The ink composition contains resin fine particles and has a viscosity of 4.5 mPa·s or less at 40° C. and a surface tension of 28 mN/m or less at 40° C.

19 Claims, 1 Drawing Sheet

(56) References Cited

U.S. PATENT DOCUMENTS

| | | | | |
|---|---|---|---|---|
| 2014/0028768 | A1* | 1/2014 | Chen | B41J 11/002 347/102 |
| 2014/0132681 | A1 | 5/2014 | Seguchi | |
| 2014/0210901 | A1* | 7/2014 | Ohashi | D06P 5/30 347/20 |
| 2014/0240399 | A1 | 8/2014 | Saito et al. | |
| 2014/0333696 | A1 | 11/2014 | Nagase et al. | |
| 2015/0267064 | A1 | 9/2015 | Saito et al. | |
| 2016/0193849 | A1 | 7/2016 | Saito et al. | |

* cited by examiner

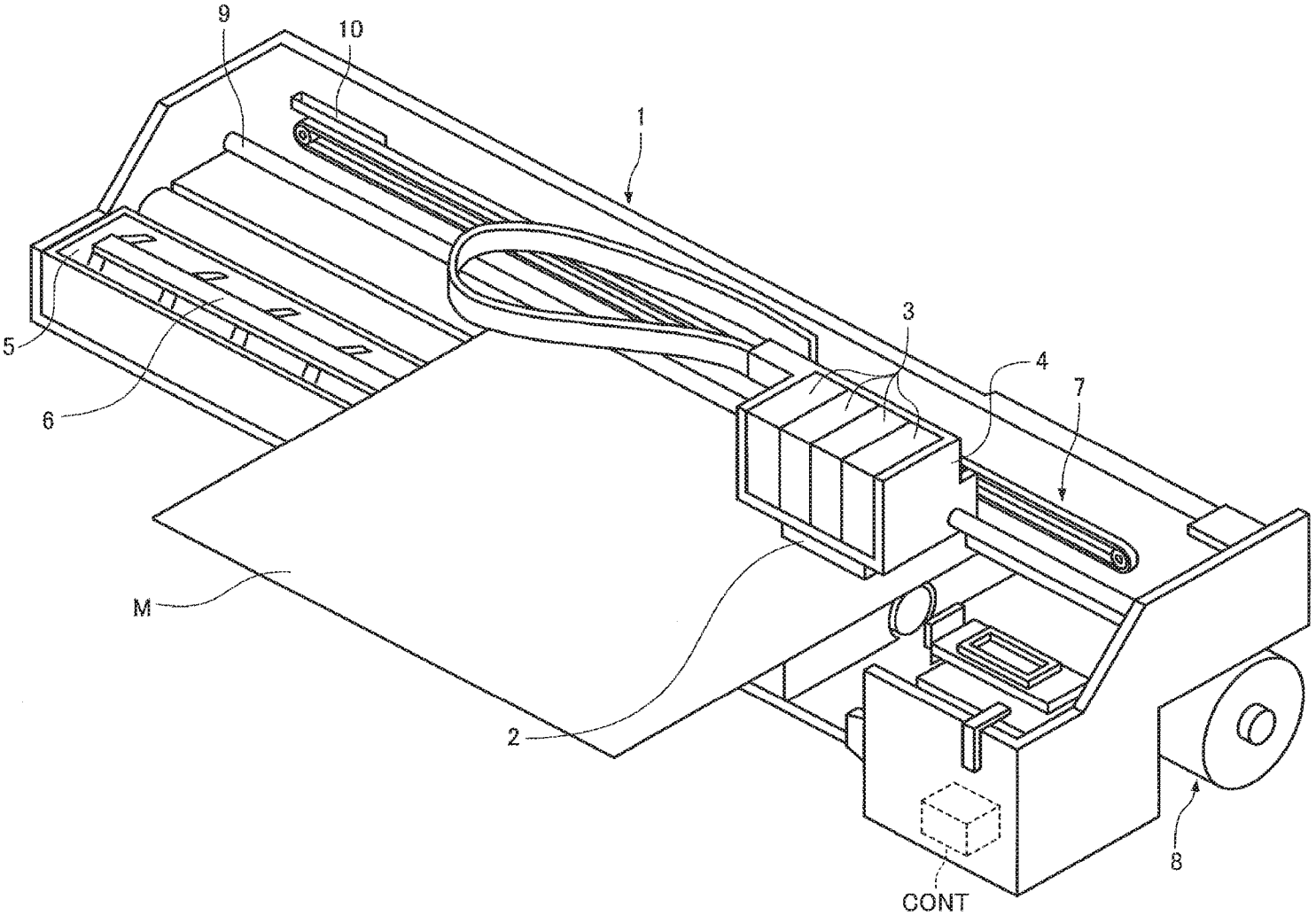
1
2
3
4
5
6
7
8
9
10
M
CONT

TEXTILE PRINTING METHOD

BACKGROUND

1. Technical Field

The present invention relates to a textile printing method.

2. Related Art

A textile printing method has been known for printing images on cloth, such as textile fabrics, knitting, and non-woven fabrics. In recent years, an ink jet printing method has been studied as a textile printing method from the viewpoint of efficiently using textile printing ink compositions (hereinafter often simply referred to as ink). In an ink jet textile printing method incorporating the ink jet method, ink is applied onto a cloth by being ejected through a nozzle of an ink jet head, thus forming an ink coating on the cloth.

The ink used in such an ink jet textile printing method may contain a coloring material, such as a pigment or a dye, a dispersant (surfactant), and a solvent, such as water or an organic solvent. Pigments are generally superior to dyes in terms of color fastness of the printed image to light and other properties, and there is disclosed a pigment textile printing method using a pigment as a coloring material (JP-A-2014-163021).

In this ink jet textile printing method, however, ink does not permeate sufficiently into the cloth, and accordingly, the fastness to laundering or rubbing of the printed image on the cloth is not satisfactory.

SUMMARY

An advantage of some aspects of the invention is that it provides a textile printing method that can produce printed articles having high fastness by an ink jet method.

The following embodiments, or applications, can solve at least one of the issues described above.

Application 1

According to an aspect of the invention, there is provides a textile printing method including heating a cloth, and applying an ink composition onto the heated cloth by ejecting the ink composition from an ink jet head. The ink composition contains resin fine particles and has a viscosity of 4.5 mPa·s or less at 40° C. and a surface tension of 28 mN/m or less at 40° C.

The ink composition having such a viscosity and surface tension can be stably ejected and is, accordingly, likely to spread evenly over the cloth and to permeate into the cloth. Thus, the ink becomes likely to be fixed to the cloth, and the resulting printed article has improved leveling and high fastness. Also, by applying the ink composition onto the heated cloth, the ink composition can be readily dried.

Application 2

The ink composition may have a viscosity in the range of 4 mPa·s to 5.5 mPa·s at 20° C.

The ink composition having such a viscosity can be more readily fixed to the cloth when being applied, and consequently, the resulting printed article has high fastness.

Application 3

The resin fine particles may have a glass transition temperature of 0° C. or less.

When the ink composition contains resin fine particles having such a glass transition temperature, the resulting printed article can be kept flexible.

Application 4

The cloth may contain polyester.

In general, resin is difficult to fix to polyester. However, the textile printing method of the present disclosure can produce printed articles having high fastness even on a cloth containing polyester.

Application 5

The textile printing method may further include applying a treatment liquid containing a flocculant capable of aggregating constituents of the ink composition onto the cloth before the applying of the ink composition.

The use of such a treatment liquid facilitates the fixing of the ink composition and helps to produce printed articles having high fastness.

Application 6

The ink composition may contain a pigment as a coloring material.

Even if the ink composition contains a pigment, the resulting printed article can exhibit high fastness, and the ink composition can be stably ejected.

Application 7

The content of the resin fine particles in the ink composition may be in the range of 1% by mass to 20% by mass.

Even if the ink composition contains resin fine particles with such a content, the resulting printed article can have high fastness, and the ink composition can be stably ejected.

Application 8

The ink composition may be aqueous.

The textile printing method using such an ink composition can produce printed articles having high fastness, and the ink composition can be stably ejected.

Application 9

The ink composition may contain an organic solvent having a normal boiling point of 250° C. or more.

The textile printing method using such an ink composition can produce printed articles having high fastness, and the ink composition can be stably ejected.

Application 10

The ink composition may contain at least one of a silicone surfactant and a fluorosurfactant.

The textile printing method using such an ink composition can produce printed articles having high fastness, and the ink composition can be stably ejected.

Application 11

The ink composition may contain a polyol compound having at least three hydroxy groups as an organic solvent.

The textile printing method using such an ink composition can produce printed articles having high fastness, and the ink composition can be stably ejected.

Application 12 the ink composition may be applied onto the cloth heated to a surface temperature of 35° C. to 65° C. by the heating of the cloth.

Application 13

According to another aspect of the invention, there is provided a textile printing apparatus configured to perform the above-described textile printing method.

The textile printing apparatus can produce printed articles having high fastness, and can stably eject the ink composition.

BRIEF DESCRIPTION OF THE DRAWINGS

The invention will be described with reference to the accompanying drawing, wherein like numbers reference like elements.

The FIGURE is a schematic perspective view of a textile printing apparatus configured to perform a textile printing method according to an embodiment of the invention.

DESCRIPTION OF EXEMPLARY EMBODIMENTS

Some embodiments of the invention will now be described. The following embodiments will be described by way of example. The invention is not limited to the following embodiments, and various modifications may be made within the scope and spirit of the invention. Not all the components disclosed in the following embodiments are required for the invention.

1. Textile Printing Method

The textile printing method according to an embodiment of the invention includes heating a cloth, and applying an ink composition onto the heated cloth by ejecting the ink composition from an ink jet head. The ink composition contains resin fine particles and has a viscosity of 4.5 mPa·s or less at 40° C. and a surface tension of 28 mN/m or less at 40° C. Also, the textile printing apparatus according to an embodiment of the invention is configured to perform the textile printing method.

Before describing the process steps of the textile printing method in detail, the structure of the textile printing apparatus, the ink composition, a treatment liquid, and the cloth will be described in that order.

1.1. Textile Printing Apparatus

An exemplary textile printing apparatus used in the textile printing method disclosed herein will first be described with reference to the drawing. The textile printing apparatus used in the textile printing method disclosed herein is not limited to the apparatus of the following embodiment.

Although an on-carriage type printer, in which an ink cartridge is mounted on a carriage, will be described as the textile printing apparatus in the present embodiment, the textile printing apparatus used in the method of the present disclosure is not limited to the on-carriage type. In an embodiment, for example, an off-carriage type printer may be used in which the ink cartridge is fixed outside the carriage without being mounted on the carriage.

The printer used in the following embodiment is a serial printer including a print head that is mounted on a carriage movable in a predetermined direction and ejects liquid droplets onto a printing medium while being moved by the movement of the carriage. However, the textile printing apparatus of the present disclosure is not limited to the serial printer and may be a line head printer including a print head disposed across the width of the printing medium so that the print head can eject liquid droplets onto the printing medium without moving.

For easy recognition, the dimensional proportions of the members and components in the drawing are changed as needed.

The textile printing apparatus may be an ink jet printer (hereinafter simply referred to as the printer) including an ink jet head as shown in, for example, the FIGURE. As shown in the FIGURE, the printer 1 includes an ink jet head 2, a carriage 4 on which ink cartridges 3 are removably mounted, a platen 5 disposed below the ink jet head 2 and on which a cloth M, or printing medium, is transported, a heating mechanism 6 configured to heat the cloth M, a carriage moving mechanism 7 configured to move the carriage 4 in a width direction of the cloth M, and a printing medium transport mechanism 8 configured to transport the cloth M in a direction. The printer 1 also includes a controller CONT configured to control the operation of the entire printer 1. The width direction of the printing medium is the main scanning direction (the direction in which the head is moved). The direction in which the printing medium is transported (medium transport direction) is the sub scanning direction (perpendicular to the main scanning direction).

The ink jet head 2, which is configured to apply an ink onto the cloth M, has a plurality of nozzles (not shown) nozzles in the surface thereof opposing the cloth M. The ink is ejected through the nozzles. The nozzles are arranged in one or more rows so as to define a nozzle surface on a nozzle plate.

For ejecting an ink through the nozzles, various techniques may be applied. For example, electrostatic suction may be used. In this case, a strong electric field is applied between the nozzles and an acceleration electrode disposed in front of the nozzles so as to eject ink droplets continuously through the nozzles, and printing information signals are transmitted between deflection electrodes to control the droplets flying between the deflection electrodes. The ink may be forcibly ejected by pressurizing a reaction liquid with a small pump and mechanically vibrating the nozzles with a quartz resonator or the like. A piezoelectric method may be used. In this case, a pressure and a printing information signal are simultaneously applied to the ink with a piezoelectric element to eject droplets of the ink for printing. Alternatively, a thermal jet method may be used. In this case, the ink is foamed by being heated with a miniature electrode according to printing information signals, thereby ejected for printing.

The ink jet head 2 may be a line ink jet head or a serial ink jet head. In the present embodiment, a serial ink jet head is used.

The textile printing apparatus, mentioned herein, including a serial ink jet head performs printing by repeating scanning operation (pass) for ejecting an ink while moving the ink jet print head relatively to the printing medium. For example, the serial ink jet print head may be mounted on a carriage that moves in the width direction of the printing medium (intersecting the medium transport direction), thus ejecting droplets while being moved accompanying the movement of the carriage.

In the case of using a textile printing apparatus including a line ink jet head, the apparatus performs printing by a single operation of scanning (pass) for ejecting ink onto a printing medium while moving the ink jet head relatively to the printing medium. such a line ink jet head may be longer than the width of the printing medium so that droplets can be ejected onto the printing medium without moving the ink jet head.

The ink cartridges 3 each configured to supply an ink to the ink jet head 2, and are defined by, for example, four independent cartridges. The four cartridges may contain different inks. The ink cartridges 3 are removable from the ink jet head 2. Although the embodiment shown in the FIGURE, the number of cartridges is four, it is not limited to four, and a desired number of cartridges may be mounted on the carriage.

The carriage 4 is held by a guide rod 9, or a holding member, extending in the main scanning direction. The carriage 4 is moved in the main scanning direction along the guide rod 9 by the carriage moving mechanism 7. Although the carriage 4 shown in the FIGURE is moved in the main scanning direction, the carriage may be moved in the sub scanning direction as well as in the main scanning direction.

The heating mechanism 6 may be disposed at any position as long as it can heat the cloth M. In the embodiment shown in the FIGURE, the heating mechanism 6 is disposed on the platen 5 at a position opposing the ink jet head 2. The heating mechanism 6 opposing the ink jet head 2 can certainly heat the droplets on the cloth M, thus efficiently drying the droplets.

The heating mechanism 6 may be a print heater mechanism that heats the droplets on the cloth M in contact with a heat source, a mechanism that emits infrared rays or microwaves (electromagnetic waves having a maximum wavelength at about 2,450 MHz), or a dryer mechanism that blows hot air.

The cloth M is heated with the heating mechanism 6 when droplets have been ejected onto the cloth M through the nozzles of the ink jet head 2. Heating conditions, such as timing of heating, heating temperature, and heating time, are controlled by a controller CONT.

In view of the wettability, the penetration, the drying degree and the ejection stability of the ink composition, the cloth M is heated so as to be kept in a predetermined temperature range. In this instance, the temperature of the cloth M to be kept is preferably in the range of 30° C. to 70° C., and more preferably in the range of 35° C. to 65° C. The heating temperature of the cloth M refers to the temperature at the surface of the cloth M that is being heated. By heating the cloth M to a temperature in the above range, the resulting printed article can have high fastness and good leveling and exhibit good color development, and the ink composition can be stably ejected.

The printer 1 may further includes a second heating mechanism (not shown) in addition to the above-described heating mechanism 6. In this instance, the second heating mechanism is disposed downstream from the heating mechanism 6 in the direction in which the cloth M is transported. The second heating mechanism heats the cloth M that has been heated with the heating mechanism 6. That is, the second heating mechanism is intended to heat the cloth M after droplets have been ejected onto the cloth M through the nozzles. Thus, the ink droplets on the cloth M can be more satisfactorily dried. Any of the mechanisms (for example, dryer mechanism) described as the heating mechanism 6 may be used as the second heating mechanism.

A linear encoder 10 detects the position of the carriage 4 in the main scanning direction as a signal. The detected signal is transmitted as positional information to the controller CONT. The controller CONT recognizes the scanning position of the ink jet head 2 according to the positional information from the linear encoder 10 and controls the printing operation (ejection) or the like of the ink jet head 2. The controller CONT also variably controls the moving speed of the carriage 4.

The textile printing method of the present embodiment is performed with the following ink composition in the textile printing apparatus just described above.

1.2. Ink Composition

The ink composition used in the textile printing method according to an embodiment of the invention contains resin fine particles and has a viscosity of 4.5 mPa·s or less at 40° C. and a surface tension of 28 mN/m or less at 40° C.

The ink composition having such a viscosity and surface tension can be stably ejected on the heated cloth and is, accordingly, likely to spread evenly over the cloth and to permeate into the cloth. Thus, the ink composition becomes likely to be fixed to the cloth, and the resulting printed article has improved leveling and high fastness to rubbing, laundering, and the like. Also, by applying the ink composition onto heated cloth, the ink composition can be readily dried.

The ingredients in the ink composition (hereinafter often simply referred to as ink) used in the textile printing method of the present embodiment will now be described.

1.2.1. Pigment

Beneficially, the ink contains a pigment as a coloring material.

The pigment is not particularly limited and may be an inorganic pigment or an organic pigment. Examples of the pigment include organic pigments, such as azo pigments, phthalocyanine pigments, condensed polycyclic compounds, nitro and nitroso compounds, hollow resin particles, and other polymer particles (e.g. Brilliant Carmine 6B, Lake Red C, watching red, disazo yellow, Hansa Yellow, phthalocyanine blue, phthalocyanine green, alkali blue, and aniline black); metals, such as cobalt, iron, chromium, copper, zinc, lead, titanium, vanadium, manganese, and nickel, and oxides or sulfides thereof, such as titanium oxide, zinc oxide, antimony oxide, zinc sulfide, and zirconium oxide; carbon blacks (C.I. Pigment Black 7), such as furnace carbon black, lamp black, acetylene black, and channel black; and other inorganic pigments, such as ocher, ultramarine blue, and Prussian blue.

Examples of carbon blacks, which are used as a black pigment, include No. 2300, No. 900, MCF 88, No. 33, No. 40, No. 45, No. 52, MA7, MA8, MA100, and No. 2200B (each produced by Mitsubishi Chemical Corporation); Raven 5750, Raven 5250, Raven 5000, Raven 3500, Raven 1255, and Raven 700 (each produced by Carbon Columbia); Regal 400R, Regal 330R, Regal 660R, Mogul L, Monarch 700, Monarch 800, Monarch 880, Monarch 900, Monarch 1000, Monarch 1100, Monarch 1300, and Monarch 1400 (each produced by CABOT); and Color Black FW1, Color Black FW2, Color Black FW2V, Color Black FW18, Color Black FW200, Color Black 5150, Color Black 5160, Color Black 5170, Printex 35, Printex U, Printex V, Printex 140U, Special Black 6, Special Black 5, Special Black 4A, and Special Black 4 (each produced by Degussa).

Exemplary white pigments include C.I. Pigment Whites 1 (basic lead carbonate), 4 (zinc oxide), 5 (mixture of zinc sulfide and barium sulfate), 6 (titanium oxide), 6:1 (titanium oxide containing other metal oxides), 7 (zinc sulfide), 18 (calcium carbonate), 19 (clay), 20 (titanated mica), 21 (barium sulfate), 22 (natural barium sulfate), 23 (gloss white), 24 (alumina white), 25 (gypsum), 26 (magnesium oxide-silicon oxide), 27 (silica), and 28 (anhydrous calcium silicate).

Exemplary yellow pigments include C.I. Pigment Yellows 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 167, 172, and 180.

Exemplary magenta pigments include C.I. Pigment Reds 1, 2, 3, 4, 5, 6, 7, 8, 9, 10, 11, 12, 14, 15, 16, 17, 18, 19, 21, 22, 23, 30, 31, 32, 37, 38, 40, 41, 42, 48(Ca), 48(Mn), 57(Ca), 57:1, 88, 112, 114, 122, 123, 144, 146, 149, 150, 166, 168, 170, 171, 175, 176, 177, 178, 179, 184, 185, 187, 202, 209, 219, 224, and 245, and C.I. Pigment Violets 19, 23, 32, 33, 36, 38, 43, and 50.

Exemplary cyan pigments include C.I. Pigment Blues 1, 2, 3, 15, 15:1, 15:2, 15:3, 15:34, 15:4, 16, 18, 22, 25, 60, 65, and 66.

Pigments other than black, white, yellow, magenta, and cyan pigments include C.I. Pigment Greens 7 and 10, C.I. Pigment Browns 3, 5, 25, and 26, C.I. Pigment Oranges 1, 2, 5, 7, 13, 14, 15, 16, 24, 34, 36, 38, 40, 43, and 63.

The above-cited pigments may be used in combination. The total content of the pigment (solids content) in the ink composition depends on the pigment used, but is preferably in the range of 1% to 30% by mass, more preferably 2% to 15% by mass, relative to the total mass of the ink composition from the viewpoint of obtaining good color development.

The pigment may be dispersed in a medium in advance, and the pigment dispersion liquid thus prepared is added into the ink composition. For preparing the pigment dispersion liquid, a self-dispersible pigment may be dispersed in a dispersion medium without using a dispersant, or a polymer dispersant may be used for dispersing a pigment. A surface-treated pigment may be dispersed in a dispersion medium.

1.2.2. Resin Fine Particles

The ink composition used in the present embodiment contains resin fine particles. The resin fine particles function to increase the fixity of the images formed with the ink composition and increase the fastness of the images.

Examples of the resin material of the resin fine particles include acrylic resins, styrene acrylic resins, fluorene-based resins, urethane-based resins, polyolefin-based resins, rosin-modified resins, terpene-based resins, polyester-based resins, polyamide-based resins, epoxy resins, vinyl chloride-based resins, vinyl chloride-vinyl acetate copolymers, and ethylene vinyl acetate resins. These resins may be used singly or in combination. In particular, urethane-based resins and acrylic resins allow designing of the ink composition with a high degree of freedom and are accordingly advantageous for imparting desired properties to the ink composition. It is beneficial to use at least one of urethane-based resins and acrylic resins. Urethane-based resins are more beneficial.

Any urethane-based resin can be used in the ink composition as long as it has a urethane skeleton and is dispersible in water. The urethane-based resin is commercially available, and examples thereof include Superflex series 460, 460s, and 840 (each produced by Dai-ichi Kogyo Seiyaku), Resamine series D-1060, D-2020, D-4080, D-4200, D-6300, and D-6455 (each produced by Dainichiseika Color & Chemicals Mfg.), Takelac series WS-5000, WS-6021, and W-512-A-6 (each produced by Mitsui Chemicals), and Sancure 2710 produced by Lubrizol).

Beneficially, the urethane-based resin is an anionic resin having an anionic functional group, such as carboxy, sulfo, or hydroxy, from the viewpoint of increasing the storage stability of the ink composition and increasing the reactivity with the polyvalent metal compound that may be contained in the treatment liquid that will be described later. The anionic urethane-based resins of the above-cited commercially available urethane-based resins are Dai-ichi Kogyo Seiyaku Superflex series 460, 460s, and 840 and Mitsui Chemicals Takelac series WS-5000, WS-6021, and W-512-A-6.

The urethane-based resin may be a polyether-type urethane resin having an ether bond as well as the urethane bond in the main chain, a polyester-type urethane resin having an ester bond as well as the urethane bond in the main chain, or a polycarbonate-type urethane resin having a carbonate linkage as well as the urethane bond in the main chain. These urethane resins may be used in combination.

The acrylic resin used in the resin fine particles may be an acrylic monomer, such as acrylic acid or an acrylic ester, or a copolymer of an acrylic monomer and other monomers, such as styrene and other vinyl monomers. The acrylic resin is commercially available, and examples thereof include Mowinyl series 702, 7502, 7525, and 7320 (each produced by Nippon Synthetic Chemical Industry).

The resin fine particles may be in the form of emulsion or solution. Emulsion is beneficial in terms of suppressing the increase in viscosity of the ink.

The resin fine particles to be added to the ink composition may be of a self-emulsifiable type containing a hydrophilic component required for stable dispersion in water, or a type that is dispersed in water by using an external emulsifier. If a treatment liquid containing a flocculant capable of aggregating constituents of the ink composition is applied to the cloth in the textile printing method, it is beneficial that the resin fine particles are in the form of a self-emulsifiable dispersion (self-emulsifiable emulsion) without containing an emulsifier. This type is not likely to inhibit the reaction with the polyvalent metal salt contained in the treatment liquid.

From the viewpoint of increasing the fixability of the ink composition and keeping the flexibility (feel and texture) of the resulting printed article, the resin fine particles in the ink composition used in the present embodiment, beneficially, have a glass transition temperature (Tg) of 0° C. or less. Preferably, the upper limit of the glass transition temperature of the resin fine particles is −10° or less, more preferably −20° or less. Also, the lower limit of the glass transition temperature (Tg) is preferably −90° C. or more and may be −80° C. or more.

The glass transition temperature (Tg) may be determined by viscoelasticity measurement, thermal analysis, or any other known analysis, or by calculation using the glass transition temperature of a known homopolymer of a polymerizable monomer. In the present disclosure, the glass transition temperature (Tg) is the value measured with a differential scanning calorimeter.

The content of the resin fine particles in terms of solids content is preferably in the range of 1% by mass to 20% by mass relative to the total mass of the ink composition, and the lower limit thereof is preferably 2.5% by mass or more, more preferably 3% by mass or more. The upper limit of the content of the resin fine particles is preferably 15% by mass or less, more preferably 12% by mass or less. When the content of the resin fine particles is in such a range, the ink composition can be stably ejected, and, in addition, the resulting printed article can have high fastness.

1.2.3. Water

The ink composition used in the present embodiment may contain water as a major solvent. The water is a major medium of the ink and will be evaporated by being dried. The water may be pure water or ultra-pure water from which ionic impurities have been removed as much as possible. Examples of such water include ion exchanged water, ultrafiltered water, reverse osmosis water, and distilled water. Sterile water prepared by, for example, UV irradiation or addition of hydrogen peroxide can prevent the occurrence of mold or bacteria in the ink stored for a long time.

The water content in the ink composition may be, but is not limited to, 50% by mass or more, 60% by mass or more, or 70% by mass or more. The upper limit of the water content in the ink composition may be 95% by mass or less, 90% by mass or less, or 80% by mass or less.

1.2.4. Organic Solvent

In the present embodiment, the ink composition may contain an organic solvent. The organic solvent improves the ejection stability of the ink composition ejected by an ink jet method, increases the adhesion of the ink composition to the cloth, and keeps the head of the ink jet printing apparatus from drying.

Beneficially, the organic solvent is soluble in water, and examples of the water-soluble organic solvent include polyol compounds, glycol ethers, betaine compounds, and pyrrolidone derivatives.

The polyol compound used may have a carbon number of 2 to 6 and contain an ether bond, and is beneficially such a diol compound. Examples of the polyol compound include glycols, such as 1,2-pentanediol, methyl triglycol (triethylene glycol monomethyl ether), butyl triglycol (triethylene glycol monobutyl ether), butyl diglycol (diethylene glycol monobutyl ether), dipropylene glycol monopropyl ether, glycerin, 1,2-hexanediol, 1,2-heptanediol, 1,3-propanediol, 1,2-butanediol, 1,3-butanediol, 1,4-butanediol, 2,3-butanediol, 2-methyl-3-phenoxy-1,2-propanediol, 3-(3-methylphenoxy)-1,2-propanediol, 3-hexyloxy-1,2-propanediol, 2-hydroxymethyl-2-phenoxymethyl-1,3-propanediol, 3-methyl-1,3-butanediol, 1,3-propanediol, 1,2-propanediol, 1,2-pentanediol, 1,4-butanediol, 1,5-pentanediol, 1,6-hexanediol, 2-methyl-2,4-pentanediol, and 3-methyl-1,5-pentanediol.

The glycol ether may be a monoalkyl ether of a glycol selected from among ethylene glycol, diethylene glycol, triethylene glycol, polyethylene glycol, polyethylene glycol, dipolyethylene glycol, tripolyethylene glycol, polypropylene glycol, and polyoxyethylene polyoxypropylene glycol. Examples of such a glycol ether include triethylene glycol monomethyl ether, triethylene glycol monobutyl ether, and dipropylene glycol monopropyl ether.

Betaine compounds are compounds whose molecule has both positive and negative charges at non-adjacent positions (inner salts), and in which the positively charged atom is not bound to a dissociable hydrogen atom and thus forms a compound not charged as a whole. A beneficial example of the betaine compound may be an N-alkyl-substituted amino acid, more beneficially an N-trialkyl-substituted amino acid. Examples of the betaine compound include trimethylglycine (often referred to as glycine betaine), γ-butyrobetaine, homarine, trigonelline, carnitine, homoserine betaine, valine betaine, lysine betaine, ornithine betaine, alanine betaine, stachydrine, and betaine glutamate. Trimethylglycine is preferred.

Some water-soluble organic solvents may be used in combination. Beneficially, the water-soluble organic solvent is added so that the ink composition can have a desired viscosity and surface tension, and the content of the water-soluble organic solvent is, for example, in the range of 1.0% by mass to 30% by mass, preferably 3.0% by mass to 25% by mass, more preferably 5.0% by mass to 20% by mass, relative to the total mass of the ink composition.

Beneficially, the ink composition contains an organic solvent having a normal boiling point of 250° C. or more, preferably 290° C. or more. Among the above-cited water-soluble organic solvents, compounds having two or more hydroxy groups have such a normal boiling point. Glycerin and other polyol compounds having three or more hydroxy groups, preferably three hydroxy groups, are advantageous. Such a compound improves the moisture-retaining property of the ink composition. Accordingly, the ink composition can be stably ejected when printing is performed with heating as in the textile printing method of the present embodiment. If an aqueous ink composition is used in the present embodiment, the aqueous ink composition containing an organic solvent having a normal boiling point of 250° C. or more keeps the moisture-retaining property thereof and can prevent the ink jet head from being dried. Also, the aqueous ink composition is easy to adjust to a viscosity and surface tension desired for the textile printing method of the present embodiment, and particularly the viscosity at 40° C. is easy to adjust to a preferred level. Thus, the ink composition containing an organic solvent having a normal boiling point of 250° C. or more can be more stably ejected and contributes to producing printed articles having improved leveling and high fastness.

The lower limit of the content of the organic solvent having a normal boiling point of 250° C. or more is preferably 5.0% by mass or more, more preferably 10% by mass or more, and may be 12% by mass or more. The upper limit of the content of the organic solvent having a normal boiling point of 250° C. or more is preferably 20% by mass or less, more preferably 17% by mass or less, and may be 15% by mass or less.

The content of glycerin or any other polyol compound having three or more hydroxy groups added as the water-soluble organic solvent to the ink composition is preferably 20% by mass or less, more preferably 17% by mass or less, and may be 15% by mass or less. The lower limit of the content of such an aqueous organic solvent is not limited, but is preferably 5.0% by mass or more, more preferably 10% by mass or more, and may be 12% by mass or more. The normal boiling point of the polyol compound having three or more hydroxy groups is preferably, but is not limited to, 250° C. or more, more preferably 290° C. or more, from the viewpoint of improving the moisture-retaining property of the ink composition.

1.2.5. Surfactant

In the present embodiment, the ink composition may contain a surfactant. The surfactant functions to reduce the surface tension of the ink composition and to improve the wettability of the ink composition on the cloth, and facilitates the adjustment of the viscosity and surface tension of the ink composition.

Beneficial surfactants include acetylene glycol-based surfactants, acetylene alcohol-based surfactants, silicone surfactants, and fluorosurfactants. Silicone surfactants and fluorosurfactants are more beneficial to adjust the ink composition to a desired surface tension.

Examples of the acetylene glycol-based surfactants include, but are not limited to, Surfynol series 104, 104E, 104H, 104A, 104BC, 104DPM, 104PA, 104PG-50, 104S, 420, 440, 465, 485, SE, SE-F, 504, 61, DF37, CT111, CT121, CT131, CT136, TG, GA, and DF110D (each produced by Air Products and Chemicals. Inc.); Olfine series B, Y, P, A, STG, SPC, E1004, E1010, PD-001, PD-002W, PD-003, PD-004, EXP. 4001, EXP. 4036, EXP. 4051, AF-103, AF-104, AK-02, SK-14, and AE-3 (each produced by Nissin Chemical Industry); and Acetylenol series E00, E00P, E40, and E100 (each produced by Kawaken Fine Chemical).

The silicone surfactant used may be, but is not limited to, a polysiloxane-based compound. For example, a polyether-modified organosiloxane may be used as the polysiloxane-based compound. Polyether-modified organosiloxanes are commercially available, and examples thereof include BYK-306, BYK-307, BYK-333, BYK-341, BYK-345, BYK-346, and BYK-348 (each produced by BYK); and KF-351A, KF-352A, KF-353, KF-354L, KF-355A, KF-615A, KF-945, KF-640, KF-642, KF-643, KF-6020, X-22-4515, KF-6011, KF-6012, KF-6015, and KF-6017 (each produced by Shin-Etsu Chemical).

The fluorosurfactant may be a fluorine-modified polymer, such as BYK-340 (produced by BYK).

The lower limit of the surfactant content is preferably 0.1% by mass or more, more preferably 0.3% by mass or more, relative to the total mass of the ink composition, and it may be 0.5% by mass or more. The upper limit of the surfactant content is preferably 10% by mass or less, more preferably 7% by mass or less, relative to the total mass of the ink composition, and it may be 5% by mass or less, 2% by mass or less, or 1% by mass or less.

1.2.6. Other Ingredients

In the present embodiment, the ink composition may optionally contain a pH adjuster, a preservative or a fungicide, a rust preventive, a chelating agent, and other additives.

pH Adjuster

Examples of the pH adjuster include potassium dihydrogenphosphate, disodium hydrogenphosphate, sodium hydroxide, lithium hydroxide, potassium hydroxide, ammonia, diethanolamine, triethanolamine, triisopropanolamine, potassium carbonate, sodium carbonate, and sodium hydrogencarbonate.

Preservative or Fungicide

Examples of the preservative or fungicide include sodium benzoate, sodium pentachlorophenol, sodium 2-pyridine thiol-1-oxide, sodium sorbate, sodium dehydroacetate, and 1,2-benzisothiazolin-3-one (Proxel CRL, Proxel BDN, Proxel GXL, Proxel XL-2, and Proxel TN, each produced by ICI).

Chelating Agent

Chelating agents capture metal ions. Exemplary chelating agents include ethylenediaminetetraacetic acid (EDTA) salts, ethylenediamine nitrilotriacetates, hexametaphosphates, pyrophosphates, and metaphosphates.

1.2.7. Preparation of Ink Composition

The ink composition used in the present embodiment is prepared by mixing the above-described ingredients in an arbitrary order and optionally removing impurities by, for example, filtration. For mixing the ingredients, for example, the ingredients are added one after another into a container equipped with a stirring device, such as a mechanical stirrer or a magnetic stirrer, and the contents of the container are stirred. Filtration may be performed as required by, for example, centrifugal filtration or using a filter paper.

1.2.8. Physical Properties of Ink Composition

The surface tension at 40° C. of the ink composition is 28 mN/m or less and is preferably 27.5 mN/m or less, more preferably 27.2 mN/m or less. Such an ink composition can be stably ejected in an ink jet textile printing process, and is likely to spread evenly over the surface of the cloth and permeate into the cloth when applied onto the cloth. Thus, the ink composition is likely to be fixed to the cloth, and the resulting printed article has high fastness. Beneficially, the lower limit of the surface tension at 40° C. of the ink composition is 25 mN/m or more, and is preferably 26 mN/m or more or 26.5 mN/m or more.

Also, from the viewpoint of spreading evenly over the surface of the cloth and readily permeating into the cloth, the ink composition preferably has a surface tension at 20° C. in the range of 20 mN/m to 40 mN/m, more preferably in the range of 25 mN/m to 35 mN/m.

The surface tension may be determined by measuring the ink composition wetting a platinum plate at 40° C. or 20° C. with, for example, an automatic surface tensiometer CBVP-Z (manufactured by Kyowa Interface Science).

The ink composition has a viscosity of 4.5 mPa·s or less, preferably 4.0 mPa·s or less or 3.5 mPa·s, at 40° C. Such an ink composition can be stably ejected in an ink jet textile printing process, and is likely to spread evenly over the surface of the cloth and permeate into the cloth when applied onto the cloth. Thus, the ink composition is likely to be fixed to the cloth, and the resulting printed article has high fastness. The lower limit of the viscosity at 40° C. of the ink composition is preferably 2.5 mPa·s or more, more preferably 2.8 mPa·s or more, such as 3.0 mPa·s or more.

Also, the viscosity at 20° C. of the ink composition is preferably in the range of 2 mPa·s to 7.0 mPa·s, more preferably in the range of 3.0 mPa·s to 6.0 mPa·s, such as in the range of 4 mPa·s to 5.5 mPa·s or 4.5 mPa·s to 5.0 mPa·s. The ink composition having such a viscosity is more likely to be fixed to the cloth, and the resulting printed article has improved leveling and high fastness.

The viscosity may be measured at 40° C. or 20° C. with, for example, a viscoelasticity meter MCR-300 (manufactured by Pysica).

1.3. Treatment Liquid

The textile printing method may further include applying a treatment liquid onto the cloth before the applying of the ink composition. The treatment liquid is used by being applied to the cloth and contains a flocculant capable of aggregating constituents of the ink composition.

1.3.1. Flocculant

The flocculant used in the treatment liquid for ink jet textile printing may be a metal salt, an organic acid, or a cationic compound (cationic resin, cationic surfactant, or the like). Such a flocculant may be used singly, or some flocculants may be used in combination. Beneficially, the flocculant is at least one selected from the group consisting of polyvalent metal salts and organic acids because these compounds are highly reactive with the resin fine particles in the ink composition. More beneficially, one or more polyvalent metals are used as the flocculant.

The polyvalent metal salt may be a water-soluble compound composed of a divalent or higher-valent metal ion and a corresponding number of anions. Exemplary polyvalent metal ions include divalent metal ions, such as $Ca^{2+}$, $Cu^{2+}$, $Ni^{2+}$, $Mg^{2+}$, $Zn^{2+}$, and $Ba^{2+}$; and trivalent metal ions, such as $Al^{3+}$, $Fe^{3+}$, and $Cr^{3+}$. Exemplary anions include $Cl^-$, $I^-$, $Br^-$, $SO_4^{2-}$, $ClO^{3-}$, $NO^{3-}$, $HCOO^-$, and $CH_3COO^-$. Calcium salts and magnesium salts are beneficial in terms of stability of the treatment liquid and reactivity as the flocculant.

Examples of the organic acids include sulfuric acid, hydrochloric acid, nitric acid, phosphoric acid, polyacrylic acid, acetic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidone carboxylic acid, pyrone carboxylic acid, pyrrole carboxylic acid, furancarboxylic acid, pyridine carboxylic acid, coumaric acid, thiophene carboxylic acid, nicotinic acid, and derivatives or salts of these acids. These organic acids may be used singly or in combination.

Exemplary cationic resins include cationic urethane resins, cationic olefin resins, and cationic allyl amine resins.

Any known cationic urethane resin may be used as the cationic urethane resin. A commercially available cationic urethane resin may be used. Examples thereof include HYDRAN series CP-7010, CP-7020, CP-7030, CP-7040, CP-7050, CP-7060, and CP-7610 (each produced by DIC); SUPERFLEX series 600, 610, 620, 630, 640, and 650 (each produced by Dai-ichi Kogyo Seiyaku); and Urethane Emulsions WBR-2120C and WBR-2122C (each produced by Taisei Fine Chemical).

Cationic olefin resins have a skeleton containing an olefin, such as ethylene or propylene. Any known olefin resin may be used as the flocculant. The cationic olefin resin may be dispersed in water or an organic solvent, thus being in the form of an emulsion. A commercially available cationic olefin resin may be used, and examples thereof include Arrowbase series CB-1200 and CD-1200 (produced by Unitika).

A cationic allyl amine resin selected from the known cationic allyl amine resins may be used as the flocculant, and examples thereof include polyallylamine hydrochloride, polyallylamine amidosulfate, allylamine hydrochloride-diallylamine hydrochloride copolymer, allylamine acetate-diallylamine acetate copolymer, allylamine hydrochloride-dimethylallylamine hydrochloride copolymer, allylamine-dimethylallylamine copolymer, polydiallylamine hydrochloride, polymethyldiallylamine hydrochloride, polymethyldiallylamine amidosulfate, polymethyldiallylamine acetate, polydiallyldimethylammonium chloride, diallylamine acetate-sulfur dioxide copolymer, diallylmethylethylammonium ethylsulfate-sulfur dioxide copolymer, methyldiallylamine hydrochloride-sulfur dioxide copolymer, diallyldimethylammonium chloride-sulfur dioxide copolymer, and diallyldimethylammonium chloride-acrylamide copolymer. Some cationic allyl amine resins are commercially available, and examples thereof include PAA-HCL-01, PAA-HCL-03, PAA-HCL-05, PAA-HCL-3L, PAA-HCL-10L, PAA-H-HCL, PAA-SA, PAA-01, PAA-03, PAA-05, PAA-08, PAA-15, PAA-15C, PAA-25, PAA-H-10C, PAA-D11-HCL, PAA-D41-HCL, PAA-D19-HCL, PAS-21CL, PAS-M-1L, PAS-M-1, PAS-22SA, PAS-M-1A, PAS-H-1L, PAS-H-5L, PAS-H-10L, PAS-92, PAS-92A, PAS-J-81L, and PAS-J-81 (each produced by Nittobo Medical); and HymoNeo-600, Hymolock series Q-101, Q-311, and Q-501, and Himax series SC-505 and SC-505 (each produced by Hymo).

Cationic surfactants include primary, secondary, or tertiary amine salts including alkyl amine salts, dialkyl amine salts, and aliphatic amine salts, quaternary ammonium salts including benzalkonium salts and other quaternary alkyl ammonium salts, alkyl pyridinium salts, sulfonium salts, phosphonium salts, onium salts, and imidazolinium salts. More specifically, examples of the cationic surfactants include hydrochlorides or acetates of laurylamine, palm amine, and rosin amine, lauryltrimethylammonium chloride, cetyltrimethylammonium chloride, benzyltributylammonium chloride, benzalkonium chloride, dimethylethyllaurylammonium sulfate, dimethylethyloctylammonium sulfate, trimethyllaurylammonium hydrochloride, cetylpyridinium chloride, cetylpyridinium bromide, dihydroxyethyllaurylamine, decyldimethylbenzylammonium chloride, dodecyldimethylbenzylammonium chloride, tetradecyldimethylammonium chloride, hexadecyldimethylammonium chloride, and octadecyldimethylammonium chloride.

The concentration of the flocculant in the treatment liquid may be 0.03 mol/kg or more. Also, it may be in the range of 0.1 mol/kg to 1.5 mol/kg, or in the range of 0.2 mol/kg to 0.9 mol/kg. The flocculant content in the treatment liquid may be in the range of 0.1% by mass to 25% by mass, 0.2% by mass to 20% by mass, or 0.3% by mass to 10% by mass, relative to the total mass of the treatment liquid.

Whether or not the flocculant has reacted with the resin in the ink composition can be determined, for example, according to whether or not the resin particles have aggregated in a resin aggregation test. More specifically, in the resin aggregation test, a solution of a flocculant with a predetermined concentration is dropped into a resin liquid containing a resin with a predetermined concentration while the mixture is stirred, and it is visually checked whether precipitation occurs in the resulting mixture.

1.3.2. Water

Beneficially, the treatment liquid used in the present embodiment contains water as a major solvent. The water will be evaporated by drying after the treatment liquid has been applied onto the printing medium. The same water as used in the ink composition may be used, and examples thereof are omitted. The water content in the treatment liquid may be 50% by mass or more relative to the total mass of the treatment liquid, and preferably 60% by mass or more, still more preferably 70% by mass or more, such as 80% by mass or more.

1.3.3. Organic Solvent

The treatment liquid may contain an organic solvent. By adding an organic solvent, the wettability of the treatment liquid on the printing medium can be increased. The same organic solvent as used in the ink composition may be used. The organic solvent content may be, but is not limited to, 1% by mass to 40% by mass relative to the total mass of the treatment liquid.

1.3.4. Surfactant

The treatment liquid may contain a surfactant. By adding a surfactant, the surface tension of the treatment liquid can be reduced, and accordingly, the wettability of the treatment liquid on the printing medium can be increased. Among surfactants, acetylene glycol-based surfactants, silicone surfactants, and fluorosurfactants are beneficial. The same surfactant as used in the ink composition may be used. The surfactant content may be, but is not limited to, 0.1% by mass to 1.5% by mass relative to the total mass of the treatment liquid.

1.3.5. Resin Fine Particles

The treatment liquid used in the present embodiment may contain a water-dispersible resin (resin emulsion) from the viewpoint of increasing the fastness and keeping the cloth from fluffing. Examples of such a resin include urethane resins, such as SUPERFLEX series 500, 6E-2000, E-2500, E-4000, and R-5000 (each produced by Dai-ichi Kogyo Seiyaku), and Adeka Bon-Tighter series HUX-822 and 830 (each produced by Adeka). Vinyl acetate resin may be used, and examples thereof include Vinyblan series 1245L, 2680, 2682, and 2684 (each produced by Nissin Chemical Industry). Acrylic resin may be used, and examples thereof include VONCOAT series AN-402, R-3310, and R-3360 (each produced by DIC). The resin fine particle content in the treatment liquid may be, but is not limited to, 1.0% by mass to 10.0% by mass relative to the total mass of the treatment liquid.

1.3.6. Other Ingredients

The treatment liquid used in the present embodiment may optionally contain a pH adjuster, a preservative or a fungicide, a rust preventive, a chelating agent, and other additives. The same additives as used in the ink composition may be used.

1.3.7. Preparation of Treatment Liquid

The treatment liquid used in the present embodiment can be prepared by mixing and dispersing the above-described ingredients in an appropriate manner. After stirring the mixture, foreign matter and coarse particles that can cause clogging are removed through a filter to yield a desired treatment liquid.

1.3.8. Physical Properties of Treatment Liquid

If the treatment liquid is applied by being ejected from an ink jet head, the surface tension of the treatment liquid at 20° C. is preferably in the range of 20 mN/m to 40 mN/m, more preferably in the range of 20 mN/m to 35 mN/m. The surface tension may be determined by measuring the treatment liquid wetting a platinum plate at 20° C. with, for example, an automatic surface tensiometer CBVP-Z (product name, manufactured by Kyowa Interface Science).

For ejecting the treatment liquid from an ink jet head as above, the viscosity of the treatment liquid at 20° C. is preferably in the range of 3 mPa·s to 10 mPa·s, more preferably in the range of 3 mPa·s to 8 mPa·s. The viscosity may be measured at 20° C. with a viscoelasticity meter MCR-300 (product name, manufactured by Pysica).

1.4. Cloth

The textile printing method of the present embodiment uses a cloth. Examples of the material of the cloth include, but are not limited to, natural fiber, such as cotton, hemp, ramie, linen, sheep wool, or silk; synthetic fiber, such as polypropylene, polyester, acetate, triacetate, polyamide, or polyurethane; biodegradable fiber, such as poly(lactic acid); and mixed fiber of these fibers. The cloth may be in any form, such as textile fabric, knitting, or nonwoven fabric. The basis weight of the cloth used in the present embodiment may be in, but is not limited to, the range of 1.0 oz (ounce) to 10.0 oz, preferably in the range of 2.0 oz to 9.0 oz, more preferably 3.0 oz to 8.0 oz, such as 4.0 oz to 7.0 oz. oz means oz/yd$^2$.

In the present embodiment, the cloth may contain polyester. Such a cloth may be polyester fabric or polyester mixed fabric. The polyester mixed fabric may contain polyester in a proportion of 20% by mass or more, preferably 50% by mass or more, still more preferably 70% by mass or more, and the fiber mixed with polyester may be, but is not limited to, cotton. The cloth containing polyester is superior in sweat and water drying, but is unlikely to allow the pigment or resin used in the ink jet textile printing to be fixed thereto. However, the textile printing method according to an embodiment described below can produce printed articles having high fastness even on cloth containing polyester.

1.5. Textile Printing Method

Process steps of the textile printing method according to an embodiment of the invention will now be described. The textile printing method of the present embodiment include heating a cloth, and applying an ink composition onto the heated cloth by ejecting the ink composition from an ink jet head. The ink composition contains resin fine particles and has a viscosity of 4.5 mPa·s or less at 40° C. and a surface tension of 28 mN/m or less at 40° C.

1.5.1. Heating Step

The textile printing method of the present embodiment includes heating a cloth. When the cloth onto which an ink will be applied is heated, the ink is heated, and the viscosity and the surface tension of the ink decrease. Thus, the ink becomes likely to spread evenly over the surface of the cloth and to permeate into the cloth. Thus, the ink becomes likely to be fixed to the cloth, and the resulting printed article has improved leveling and high fastness. Also, by applying the ink composition onto the heated cloth, the ink composition can be readily dried. Consequently, damage to the cloth can be reduced because the time required for drying is reduced.

For example, the cloth may be heated by, but not limited to, a heat press method, a normal-pressure steaming method, a high-pressure steaming method, or a thermal fixing method. The heat source for the heating may be, but is not limited to, infrared rays (lamp). The cloth may be heated with a heater attached to a support member supporting the cloth, from the side opposite the ink jet head with respect to the cloth, or heated by blowing hot air on the cloth or irradiating the cloth with heat from a heat source.

The cloth is heated to a surface temperature in the range of preferably 30° C. to 70° C., more preferably 35° C. to 65° C. By heating the cloth to a surface temperature in such a range, damage to the ink jet head and the cloth can be reduced, and the ink becomes likely to spread evenly over the surface of the cloth and to permeate into the cloth. The heating temperature in this heating step refers to the surface temperature of the heated cloth and may be measured with, for example, a non-contact type thermometer IT2-80 (manufactured by Keyence). The surface temperature of the heated cloth is preferably 40° C. or more, more preferably 45° C. or more. Also, the upper limit of the surface temperature is preferably 60° C. or less, and more preferably 55° C. or less or 50° C. or less. From the viewpoint of stably ejecting the ink composition, it is desirable the surface temperature be 45° C. or less. Beneficially, the textile printing apparatus used in the textile printing method of the present embodiment includes a mechanism capable of controlling the surface temperature of the cloth in the above range.

The heating time is not particularly limited as long as the cloth can be heated to the above described surface temperature. For example, it may be in the range of 5 s to 1 min and is preferably in the range of 10 s to 30 s. When the cloth is heated for such a time, damage to the ink jet head and the cloth can be reduced, and the cloth is sufficiently heated.

1.5.2. Applying Ink Composition

In the step of applying the ink composition, the ink composition is ejected from an ink jet head onto the cloth that has been heated in the above-described heating, thus printing an image on the cloth. The surface temperature of the cloth in the step of applying the ink composition is preferably in the range of 30° C. to 70° C. Thus, a printed article including the image printed on the cloth with the ink composition is produced.

In the present embodiment, an ink containing resin fine particles and having a viscosity of 4.5 mPa·s or less at 40° C. and a surface tension of 28 mN/m or less at 40° C. is applied onto a cloth heated to the above-mentioned surface temperature. Under these conditions, the ink can be stably ejected and is likely to spread evenly over the surface of the cloth and permeate into the cloth. Thus, the ink composition becomes likely to be fixed to the cloth, and the resulting printed article has improved leveling and high fastness to rubbing, laundering, and the like. Also, by applying the ink composition onto the heated cloth, the ink composition can be readily dried.

If the cloth is pretreated as described later, the ink composition is applied to at least a part of the region of the cloth pretreated with the treatment liquid. Consequently, the coloring material and other constituents in the ink composition react with the flocculant to aggregate on the cloth, thus producing images exhibiting good color development. In addition, the reaction of the coloring material with the flocculant enhances the fastness of printed images.

Any technique may be applied to the ink jet printing method. For example, the ink composition may be ejected by a charge deflection method, a continuous ejection method, an on-demand method, such as a piezoelectric method or a bubble jet (registered trademark) method. Among these ink jet printing methods, a method using a piezoelectric ink jet apparatus is more advantageous.

The maximum amount of the ink composition applied onto the cloth may be in the range of 1 mg/cm$^2$ to 200 mg/cm$^2$, and preferably in the range of 1 mg/cm$^2$ to 30 mg/cm$^2$, more preferably 2 mg/cm$^2$ to 25 mg/cm$^2$, such as 5 mg/cm$^2$ to 20 mg/cm$^2$ or 7 mg/cm$^2$ to 15 mg/cm$^2$, in view of the color development and easy drying of printed images, and from the viewpoint of preventing bleeding in the images and of printing graphics, text, and other images on the cloth with good repeatability.

1.5.3. Pretreatment

A treatment liquid containing a flocculant capable of aggregating constituents of the ink composition may be applied onto the cloth before the step of applying the ink composition.

The above-described treatment liquid may be used for this pretreatment. The amount of the treatment liquid to be applied is preferably in the range of 0.02 g/cm$^2$ to 0.5 g/cm$^2$, more preferably 0.02 g/cm$^2$ to 0.24 g/cm$^2$. Such an amount of the treatment liquid is easy to apply onto the cloth, and consequently, unevenness and bleeding in the resulting image can be reduced.

Beneficially, the treatment liquid is applied so that the polyvalent metal salt contained therein can be applied to the cloth at a rate in the range of 1.6 μmol/cm$^2$ to 6 μmol/cm$^2$, preferably 2 μmol/cm$^2$ to 5 μmol/cm$^2$. By applying the polyvalent metal salt at a rate of 1.6 μmol/cm$^2$ or more, the resulting printed image exhibits good color development. Also, by applying the polyvalent metal salt at a rate of 6 μmol/cm$^2$ or less, the resulting printed image has high fastness.

For applying the treatment liquid to the cloth, the cloth may be dipped in the treatment liquid (dip coating), or the treatment liquid may be applied with a roll coater or the like (roller coating), sprayed from a spraying device or the like (spray coating), or ejected by an ink jet method (ink jet coating). Any method may be used.

The textile printing method may further include drying the treatment liquid applied onto the cloth. In this instance, the treatment liquid may be naturally dried, or may be heated for drying from the viewpoint of increasing drying speed. If the treatment liquid is dried by heating, the heating may be performed by, but not limited to, a heat press method, a normal-pressure steaming method, a high-pressure steaming method, or a thermal fixing method. The heat source for the heating may be, but is not limited to, infrared rays (lamp).

In the present embodiment, a second heating mechanism may be disposed downstream in the direction in which the cloth is transported, and the cloth is heated or dried after the ink composition has been applied. In this instance, the second heating mechanism is disposed downstream from the heating mechanism 6 shown in the FIGURE in the direction in which the cloth M is transported. Thus, the ink droplets on the cloth M can be more satisfactorily dried. Any of the mechanisms (for example, dryer mechanism) described as the heating mechanism 6 may be used as the second heating mechanism.

In this heating, the cloth is heated to a temperature preferably in the range of 150° C. to 200° C., more preferably 160° C. to 180° C. The heating to a temperature in such a range helps the resin in the ink composition to form a coating without damaging the cloth much. The time for this heating may be in, but is not limited to, the range of 30 s to 20 min and is preferably in the range of 2 min to 7 min, such as 3 min to 5 min. When the cloth is heated for such a time, damage to the cloth can be reduced, and the ink can be sufficiently dried.

In the textile printing method of the present embodiment, the ink composition having a predetermined viscosity and surface tension is applied to a heated cloth. Consequently, the ink composition is stably ejected and is likely to spread evenly over the cloth and to permeate into the cloth. Thus, the ink composition becomes likely to be fixed to the cloth, and the resulting printed article has improved leveling and high fastness to rubbing, laundering, and the like. Also, since the ink composition is applied onto the heated cloth, the ink composition can be readily dried, and the resulting printed article has improved leveling and high fastness. 2. Examples The present disclosure will now be further described in detail with reference to Examples, Reference Examples, and Comparative Examples. However, it is not limited to the Examples. In the following Examples, Reference Examples and Comparative Examples, "part(s)" and "%" are on a mass basis unless otherwise specified.

2.1. Preparation of Ink Compositions

The ingredients shown in Table 1 were mixed and stirred for 2 hours with a magnetic stirrer. The mixture was then filtered through a membrane filter having a pore size of 5 μm. Thus, inks 1 to 8 were prepared. The values in Tables 1 are represented on a percent-by-mass basis, and ion exchanged water was added so that the total of the ink composition came to 100% by mass.

TABLE 1

| | Ink 1 | Ink 2 | Ink 3 | Ink 4 | Ink 5 | Ink 6 | Ink 7 | Ink 8 |
|---|---|---|---|---|---|---|---|---|
| Magenta pigment dispersion, pigment content | 5 | 5 | 5 | 5 | 5 | 5 | 5 | 5 |
| Takelac WS-6021 | 5 | 5 | 5 | 5 | | 3 | 5 | |
| Takelac WS-5000 | | | | | | | | 5 |
| Glycerin | 13 | 10 | 16 | 13 | 13 | 13 | 18 | 13 |
| Triethylene glycol | 3 | 3 | 3 | 3 | 3 | 3 | 3 | 3 |
| Triethylene glycol monobutyl ether | 1 | 1 | 1 | 1 | 1 | 1 | 1 | 1 |
| BYK-348 | 0.5 | 0.5 | 0.5 | 0.2 | 0.5 | 0.5 | 0.5 | 0.5 |
| Ion exchanged water | Balance | Balance | Balance | Balance | Balance | Balance | Balance | Balance |
| Total | 100 | 100 | 100 | 100 | 100 | 100 | 100 | 100 |

The ingredients shown in Table 1 are as follows:

Magenta pigment (Pigment Red 122)

Takelac WS-6021 (self-emulsifiable urethane resin emulsion produced by Mitsui Chemicals, glass transition temperature:

60° C., solids content: 30%)

Takelac WS-5000 (self-emulsifiable urethane resin emulsion produced by Mitsui Chemicals, glass transition temperature: 65° C., solids content: 30%)

BYK-348 (polysiloxane-based surfactant produced by BYK)

Glass transition temperature is measured with a differential scanning calorimeter EXSTAR 6000 DSC (manufactured by Seiko Instruments).

2.2. Preparation of Treatment Liquids

Ingredients were mixed with proportions shown in Table 2 and stirred. Thus, treatment liquids 1 and 2 were prepared. Ion exchanged water was added so that the total of the treatment liquid came to 100% by mass.

TABLE 2

| | Treatment liquid 1 | Treatment liquid 2 |
|---|---|---|
| Flocculant, Calcium nitrate tetrahydrate | 7 | |
| Flocculant, acetic acid | | 7 |
| Resin, Vinyblan 1245L | 5 | 5 |
| Surfactant BYK-348 | 0.15 | 0.15 |
| Ion exchanged water | Balance | Balance |
| Total | 100 | 100 |

The ingredients shown in Table 2 are as follows:

Vinyblan 1245L (vinyl acetate-based emulsion produced by Nissin Chemical Industry)

BYK-348 (polysiloxane-based surfactant produced by BYK)

2.3. Evaluation

Test samples of Examples, Reference Examples, and Comparative Examples for examinations shown in Table 3 were prepared as below. Comparative Examples 3 and 4 are omitted.

Printing Test

An ink jet textile printing apparatus modified from SC-F2000 (manufactured by Seiko Epson) was prepared. A heater was attached to the platen for supporting the cloth so that the surface of the cloth could be controlled to the temperature shown in Table 3 when the ink was applied (during printing). More specifically, the surface temperature of the cloth was measured at a position opposing the head with a non-contact type thermometer IT2-80 (manufactured by Keyence), and the platen heater was adjusted so that the cloth could be heated to an intended surface temperature (printing drying temperature shown in Table 3). In the cases of 25° C. in Table 3, the heater was turned off. For main heating (drying after printing), an oven additionally provided apart from the platen heater of the ink jet textile printing apparatus was used, and the temperature was measured in the same manner as the printing drying temperature. One of the nozzle lines of the head was charged with the ink.

First, the treatment liquid was evenly applied onto the cloth at a rate of 3 g per A4 sheet by spray coating. After the spray coating, the cloth was heated at 60° C. for 5 min for full drying. Then, a cloth was set to the printer, and the ink was ejected onto the cloth from the head to print a test pattern. The ink was applied at a resolution of 1440 dpi× 1440 dpi and a rate of 15 mg/inch$^2$. After applying the ink, the cloth ejected from the printer was heated at 150° C. for 2 min.

Cloth 1 was 100% polyester white cloth (manufacture by Henes), and Cloth 2 was 100% cotton white cloth (heavy weight, manufactured by Hanes).

Ejection Stability Test

The above-described printing test was continuously performed for 1 hour, and then, the nozzle line (having 360 nozzles) was checked for abnormal ejection (non-ejection). All the nozzles were normal at the beginning of printing, and evaluated according to the following criteria:

Excellent: No abnormal ejection occurred at any nozzle.

Good: Abnormal ejection occurred at one or two nozzles.

Fair: Abnormal ejection occurred at three to five nozzles.

Bad: Abnormal ejection occurred at five or more nozzles.

Color Development

The printed articles produced in the printing test were visually observed.

Good: Ink was not seen on the rear side of the cloth, and the pattern on the front side was filled with the color of the ink.

Fair: Ink was slightly seen on the rear side of the cloth.

Bad: Ink penetrated the cloth and reached the rear side, and the color of the ink was considerably seen on the rear side.

Leveling

The test patterns of the printed articles formed in the printing test were visually observed.

Excellent: The pattern was uniformly colored with the ink, and the color of the cloth in the pattern was not seen.

Good: The color of the cloth in the pattern was not seen, but the color of the ink was slightly uneven.

Fair: The cloth was slightly seen in the pattern.

Bad: The color of the cloth was considerably seen in the pattern.

Fastness to Rubbing Under Dry Condition

The pattern of each printed article was subjected to Rub fastness test II by the dry method specified in JIS L 0849 and the results were rated according to the JIS standard.

Fastness to Laundering

The fastness to laundering of the printed articles was tested. The samples were tested in accordance with AATCC 61 (2A and 3A) and were visually evaluated according to the following criteria. 2A refers to washing at 25° C., and 3A refers to washing at 60° C.

AA: The pattern coating was not removed even by 2A and 3A tests.

A: The pattern coating was not removed by 2A test, but was slightly removed by 3A test.

B: The pattern coating was slightly removed by 2A test.

C: Large part of the pattern coating was removed by each of 2A and 3A tests.

2.4. Evaluation Results

Evaluation results are shown in Table 3.

TABLE 3

| | Example 1 | Example 2 | Example 3 | Example 4 | Example 5 | Example 6 | Example 7 | Example 8 | Example 9 | Example 10 |
|---|---|---|---|---|---|---|---|---|---|---|
| Ink No. | Ink 1 | Ink 6 | Ink 8 | Ink 6 | Ink 6 | Ink 6 | Ink 1 | Ink 1 | Ink 2 | Ink 3 |
| Printing drying temperature (Surface temperature of cloth) | 50° C. | 50° C. | 50° C. | 50° C. | 50° C. | 50° C. | 40° C. | 60° C. | 50° C. | 50° C. |
| Main drying time (170° C.) | 3 min | 3 min | 3 min | 3 min | 3 min | 3 min | 4 min | 2 min | 3 min | 5 min |
| Viscosity at 20° C. (mPa · s) | 4.8 | 4.8 | 4.8 | 4.8 | 4.8 | 4.8 | 4.8 | 4.8 | 4.2 | 5.7 |
| Viscosity at 40° C. (mPa · s) | 3 | 3 | 3 | 3 | 3 | 3 | 3 | 3 | 2.3 | 3.7 |
| Surface tension at 40° C. (mN/m) | 27.2 | 27.2 | 27.2 | 27.2 | 27.2 | 27.2 | 27.2 | 27.2 | 27.8 | 26.7 |
| Treatment liquid | Treatment liquid 1 | Treatment liquid 1 | Treatment liquid 1 | Treatment liquid 2 | — | Treatment liquid 1 | Treatment liquid 1 | Treatment liquid 1 | Treatment liquid 1 | Treatment liquid 1 |
| Cloth | Cloth 1 | Cloth 1 | Cloth 1 | Cloth 1 | Cloth 1 | Cloth 2 | Cloth 1 | Cloth 1 | Cloth 1 | Cloth 1 |
| Leveling | Excellent | Excellent | Excellent | Excellent | Excellent | Excellent | Good | Excellent | Excellent | Fair |

TABLE 3-continued

| | | | | | | | | | | |
|---|---|---|---|---|---|---|---|---|---|---|
| Fastness to rubbing (Dry) Rating JIS L 0849 II | 4 | 3-4 | 3-4 | 4 | 5 | 4 | 3-4 | 4 | 4 | 3-4 |
| Ejection stability | Excellent | Excellent | Excellent | Excellent | Excellent | Excellent | Excellent | Good | Fair | Good |
| Color development | Good | Good | Good | Fair | Bad | Good | Good | Good | Good | Good |
| Fastness to laundering | AA | A | A | AA | AA | AA | A | AA | AA | B |

| | Comparative Example 1 | Comparative Example 2 | Reference Example 1 | Reference Example 2 | Comparative Example 5 | Comparative Example 6 | Comparative Example 7 | Comparative Example 8 | Comparative Example 9 | Reference Example 3 |
|---|---|---|---|---|---|---|---|---|---|---|
| Ink No. | Ink 5 | Ink 1 | Ink 1 | Ink 1 | Ink 4 | Ink 7 | Ink 7 | Ink 1 | Ink 4 | Ink 1 |
| Printing drying temperature (Surface temperature of cloth) | 50° C. | 25° C. | 30° C. | 70° C. | 50° C. | 50° C. | 50° C. | 25° C. | 50° C. | 25° C. |
| Main drying time (170° C.) | 3 min | 7 min | 7 min | 2 min | 3 min | 5 min | 5 min | 7 min | 3 min | 7 min |
| Viscosity at 20° C. (mPa · s) | 4.8 | 4.8 | 4.8 | 4.8 | 4.7 | 6.6 | 6.6 | 4.8 | 4.7 | 4.8 |
| Viscosity at 40° C. (mPa · s) | 3 | 3 | 3 | 3 | 2.9 | 4.8 | 4.8 | 3 | 2.9 | 3 |
| Surface tension at 40° C. (mN/m) | 27.2 | 27.2 | 27.2 | 27.2 | 28.5 | 26.7 | 26.7 | 27.2 | 28.5 | 27.2 |
| Treatment liquid | Treatment liquid 1 | Treatment liquid 1 | Treatment liquid 1 | Treatment liquid 1 | Treatment liquid 1 | Treatment liquid 1 | — | — | — | Treatment liquid 1 |
| Cloth | Cloth 1 | Cloth 1 | Cloth 1 | Cloth 1 | Cloth 1 | Cloth 1 | Cloth 1 | Cloth 1 | Cloth 1 | Cloth 2 |
| Leveling | Excellent | Fair | Fair | Excellent | Fair | Bad | Bad | Fair | Fair | Fair |
| Fastness to rubbing (Dry) Rating JIS L 0849 II | 1 | 2 | 3 | 4 | 2 | 2 | 3 | 3 | 3 | 3 |
| Ejection stability | Excellent | Excellent | Excellent | Bad | Excellent | Good | Good | Excellent | Excellent | Excellent |
| Color development | Good | Good | Good | Good | Good | Good | Good | Bad | Bad | Good |
| Fastness to laundering | C | C | B | AA | C | C | AA | A | A | A |

As shown in Table 3, Examples 1 to 10 exhibited high fastness to both rubbing and laundering and good ejection stability. In comparison among Examples 1, 2, and 3, the fastness to rubbing and laundering in Example 1 was higher than that in Examples 2 and 3. This is probably because the ink used in Example 1 contained resin fine particles with a higher content than the ink used in Example and accordingly increased the fixity of the image, thus increasing the fastness of the image. Also, the resin fine particles in the ink used in Example 3 have a glass transition temperature higher than 0°. This is probably the reason why the fixability of the ink was lower than that in Example 1. The results of Examples 2, 4, and 5 suggest that use of a treatment liquid slightly reduces the fastness of the image, but increases the color development of the image, and that a polyvalent metal salt is more beneficial as the flocculant in the treatment liquid.

The results of Examples 1, 7, and 8 suggest that the printing drying temperature is involved in fastness and ejection stability. In Example 7, in which the printing drying temperature was lower than that in Example 1, the leveling was slightly lower than that in Example 1, and the fastness to rubbing and laundering was lightly reduced. On the other hand, in Example 8, in which the printing drying temperature was higher than that in Example 1, the leveling and the fastness to rubbing and laundering were almost the same as in Example 1, but the ejection stability was reduced. The results of Examples 1, 9, and 10 suggest that the glycerin content in the ink, as well as the printing drying temperature, is involved in the fastness of the image and the ejection stability of the ink. Example 9, in which the glycerin content was lower than that in Example 1, exhibited lower ejection stability than Example 1, and Example 10, in which the glycerin content was higher than that in Example 1, exhibited lower leveling and fastness to rubbing and laundering than Example 1.

The results of Example 6, which used 100% polyester cloth, were the same as the results of Examples using 100% cotton cloth.

In Comparative Examples 1 to 9, on the other hand, fastness and ejection stability were incompatible. The test results show that the method in which an ink composition containing resin fine particles and having a viscosity of 4.5 mPa·s or less at 40° C. and a surface tension of 28 mN/m or less at 40° C. is applied onto a cloth heated to a surface temperature in the range of 35° C. to 65° C. by being ejected from an ink jet head for ink jet textile printing, as described above, allows the ink composition to be stably ejected and produces images having high fastness. It has been also found that by adjusting the glycerin content in the ink composition and the printing drying temperature, the ejection stability of the ink composition and the fastness of the resulting image can be increased.

The invention is not limited to the above-described embodiments, and various modifications may be made. For example, the invention includes substantially the same form as the disclosed embodiments (for example, a form including the same function and method and producing the same result, or a form having the same intent and producing the same effect). Some elements unessential to the form of the disclosed embodiment may be replaced. The form of an embodiment of the invention includes an element producing the same effect or achieving the same object, as the form of the disclosed embodiments. The forms of the disclosed embodiments may be combined with the known art.

The entire disclosure of Japanese Patent Application No. 2016-162807, filed Aug. 23, 2016 is expressly incorporated by reference herein.

What is claimed is:

1. A textile printing method comprising:

a first heating process that includes heating a cloth before applying an ink composition to the cloth, a temperature of the first heating process being in a range between 35° C. to 65° C.;

an applying process that includes applying the ink composition onto the heated cloth by ejecting the ink composition from an ink jet head; and a second heating process that includes heating the cloth after applying the ink composition, a temperature of the second heating process being in a range between 150° C. to 200° C., wherein the ink composition contains resin fine particles and has a viscosity of 4.5 mPa·s or less at 40° C. and a surface tension of 28 mN/m or less at 40° C.

2. The textile printing method according to claim 1, wherein the viscosity of the ink composition at 20° C. is in the range of 4 mPa·s to 5.5 mPa·s.

3. The textile printing method according to claim 1, wherein the resin fine particles have a glass transition temperature of 0° C. or less.

4. The textile printing method according to claim 1, wherein the cloth contains polyester.

5. The textile printing method according to claim 1, further comprising applying a treatment liquid containing a flocculant capable of aggregating constituents of the ink composition onto the cloth before the applying of the ink composition.

6. The textile printing method according to claim 1, wherein the ink composition contains a pigment as a coloring material.

7. The textile printing method according to claim 1, wherein the content of the resin fine particles in the ink composition is in the range of 1% by mass to 20% by mass.

8. The textile printing method according to claim 1, wherein the ink composition is aqueous.

9. The textile printing method according to claim 1, wherein the ink composition contains an organic solvent having a normal boiling point of 250° C. or more.

10. The textile printing method according to claim 1, wherein the ink composition contains at least one of a silicone surfactant and a fluorosurfactant.

11. The textile printing method according to claim 1, wherein the ink composition contains a polyol compound as an organic solvent, the polyol compound having at least three hydroxy groups.

12. A textile printing apparatus configured to perform the textile printing method as set forth in claim 1, the textile printing apparatus comprising:

the ink jet head; and a heating mechanism configured to perform the heating of the cloth.

13. A textile printing apparatus configured to perform the textile printing method as set forth in claim 2, the textile printing apparatus comprising:

the ink jet head; and a heating mechanism configured to perform the heating of the cloth.

14. A textile printing apparatus configured to perform the textile printing method as set forth in claim 3, the textile printing apparatus comprising:

the ink jet head; and a heating mechanism configured to perform the heating of the cloth.

15. A textile printing apparatus configured to perform the textile printing method as set forth in claim 4, the textile printing apparatus comprising:

the ink jet head; and a heating mechanism configured to perform the heating of the cloth.

16. A textile printing apparatus configured to perform the textile printing method as set forth in claim 5, the textile printing apparatus comprising:

the ink jet head; and a heating mechanism configured to perform the heating of the cloth.

17. A textile printing apparatus configured to perform the textile printing method as set forth in claim 6, the textile printing apparatus comprising:

the ink jet head; and a heating mechanism configured to perform the heating of the cloth.

18. A textile printing apparatus configured to perform the textile printing method as set forth in claim 7, the textile printing apparatus comprising:

the ink jet head; and a heating mechanism configured to perform the heating of the cloth.

19. A textile printing apparatus configured to perform the textile printing method as set forth in claim 8, the textile printing apparatus comprising:

the ink jet head; and a heating mechanism configured to perform the heating of the cloth.

* * * * *